United States Patent [19]

Hamm

[11] Patent Number: 4,698,880

[45] Date of Patent: Oct. 13, 1987

[54] DEVICE FOR RETARDING THE POSITION OF BEDCLOTHING

[76] Inventor: Jerry A. Hamm, 2018 McMillan Ave., Wallace, N.C. 28466

[21] Appl. No.: 898,411

[22] Filed: Aug. 21, 1986

[51] Int. Cl.[4] ..... A44B 21/00

[52] U.S. Cl. ..... 24/72.5; 24/462; 5/498

[58] Field of Search ..... 24/72.5, 462, 461, 460, 24/371; 5/498, 508, 496

[56] References Cited

U.S. PATENT DOCUMENTS

| | | | |
|---|---|---|---|
| 557,456 | 3/1896 | Utter | 24/72.5 |
| 2,024,050 | 12/1935 | May | 24/72.5 |
| 2,791,784 | 5/1957 | Tomsic | 24/371 |
| 2,931,084 | 4/1960 | DeWitt | 24/72.5 |
| 3,141,221 | 7/1964 | Faulls, Jr. | 24/462 |
| 3,205,547 | 9/1965 | Riekse | 24/462 |
| 3,520,030 | 7/1970 | Hawkins | 24/72.5 |
| 4,199,831 | 4/1980 | Müller | 5/498 |
| 4,276,667 | 7/1981 | Osbourne | 5/498 |
| 4,520,518 | 6/1985 | Reaser | 24/72.5 |
| 4,541,137 | 9/1985 | Murray | 5/498 |

*Primary Examiner*—Victor N. Sakran

*Attorney, Agent, or Firm*—Charles R. Rhodes; Judith E. Garmon

[57] ABSTRACT

An assembly including a clasp member having a pair of opposing upper and lower gripping jaws which receive selected portions of sheets therein; and a wedge member for insertion between the inner surface of said gripping jaws along with the bedsheets for locking the sheets between the clasp member and the wedge member. The preferred wedge has a triangular cross-section and being of a size somewhat smaller than the space between the opposed gripping jaws, to provide some clearance when the wedge is inserted between the gripping jaws. When tension is applied to the sheets the wedge member is caused to rotate and wedge the edges thereof against the inner surfaces of the gripping jaws to more tightly grip and retain the sheets in position.

6 Claims, 5 Drawing Figures

FIG. 1
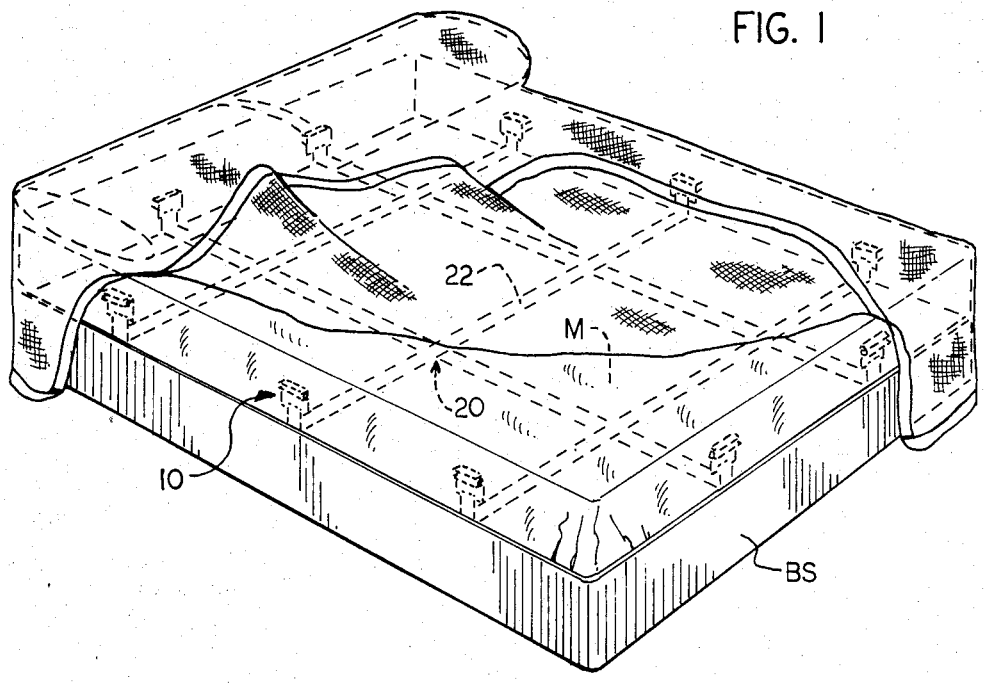
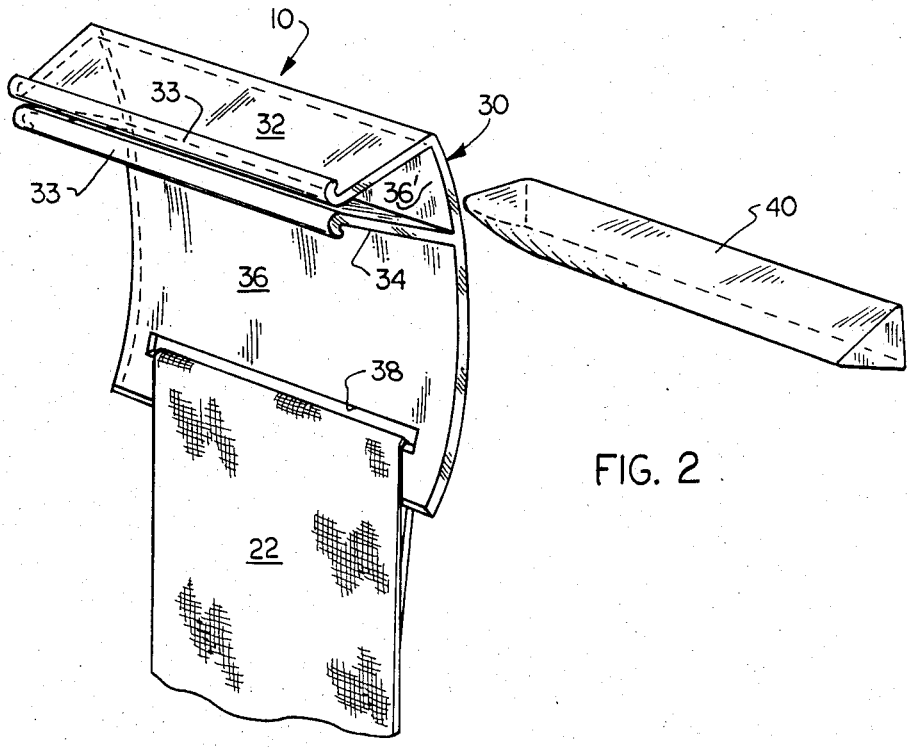
FIG. 2

DEVICE FOR RETARDING THE POSITION OF BEDCLOTHING

BACKGROUND AND SUMMARY OF THE PRESENT INVENTION

Retainers for sheets, blankets and other bedclothing long have been desirable to prevent pulling loose while sleeping. It is frequently the practice, particularly with children, to tuck the sheets and/or blankets between the mattress and boxsprings along the bottoms and sides thereof. Although the positioning may initially be tight and close to the bed, continual checking is required to ensure that the sheets and blankets have not come loose and pulled away from the bed. One approach for retaining the lower sheet in place is the fitted sheet. Variations in mattress thickness and the tendency for the corners of fitted sheets to come up keep them from being entirely satisfactory. Also the fitted sheet approach is not applicable to the upper sheet.

Known devices for retaining sheets or bedclothing in place are disclosed in U.S. Pat. Nos. 4,541,137; 4,520,518; 4,276,667; 4,461,049; 4,389,744; and 2,791,784. These patents represent a wide variety of clamps and grippers used for grasping a bedsheet or at least a portion thereof and holding the sheet tightly against the mattress. Specifically, U.S. Pat. No. 4,541,137 discloses a clamping device wherein an elongated flat arm is joined perpendicularly to a U-shaped clamp between the legs of which is clamped a portion of the bedsheet or blanket. The flat arm portion is inserted between the mattress and boxsprings so that the clamping portion extends outwardly along the side of the mattress and grasps the edge of the sheet therein. The edges of the bedclothing not grasped by the clamp are tucked between the mattress and boxsprings in the usual manner.

One recurring problem with most of the known devices is that the devices prevent the tucking of the clamped edge portion of the edges underneath the mattress. Therefore, an undesirable wrinkling and pulling of the edges of the sheets and blankets occurs when some portions of the edge can be tucked under the mattress and other portions of the edges cannot be tucked under. Another problem that exists with known devices is that bedclothing can be relatively easily pulled out of the clamps or retainers when tension is applied to the clothing such as occurs during normal sleeping movement. None of the known devices include a means for increasing the gripping action of the retainers as tension is applied to the bedclothing.

The present invention overcomes these problems through a uniquely designed clamping structure which includes a pair of gripping jaws which receive selected portions of the edges of the bedclcthing, which bedclothing is locked into the gripping jaws by a wedge member inserted therein. The design of the wedge member in a preferred embodiment is generally an elongated member having a triangular cross-section of a size somewhat smaller than the opening that exists between the opposing inner surfaces of the gripping jaws. The wedge member is used to feed the sheet(s) into the area between the gripping jaws, along with the bedclothing then locks the bedclothing tightly in the clasp member. The size and the shape of the wedge member are designed so that when tension is applied to the bedclothing, the wedge is caused to rotate in the clasp member and by so rotating the angular edges of the wedge engage and lock tightly against the inner surface of the gripping jaws to exert a locking force against the bedclothing trapped therein (referred to hereinafter as "positive gripping action"). This positive gripping action ensures that as movement on the bedding occurs and tension is applied against the bedding in a way that would normally dislodge the bedclothing, with the present device the bedclothing is held more tightly during such movement and therefore cannot pull out of position. None of the prior art devices exert a positive gripping action on the bedclothing when under tension. Rather, known devices merely press the sheet against the surface of the mattress or lock the sheet between cooperating parts that will pull apart when tension is applied to the bedclothing. For example, in U.S. Pat. No. 4,541,137, the cooperating elements of the latching member will be caused to pull apart when tension is applied to the bedclothing.

The aforedescribed clasp members may be built into the side and end walls of the mattress, provided on a harness that includes longitudinal and transverse straps, or at the ends of separate straps. The straps will exhibit sufficient elasticity to return the sheet to its taut position when the tension is released.

The primary objective of providing a bedclothing retainer that exerts a positive gripping action against the bedclothing, which positive gripping action is increased as tension is applied to the bedclothing, is clearly met by the present invention. Other objectives and modifications of the present invention will become more apparent as the following detailed description studied in conjunction with the accompanying drawings. In the drawings:

FIG. 1 shows a perspective view of the bedclothing retainer as positioned on a conventional bed including a mattress and boxsprings;

FIG. 2 is an enlarged perspective view of the clasp member and the separate wedge member;

DETAILED DESCRIPTION OF A PREFERRED EMBODIMENT

Figure 5:
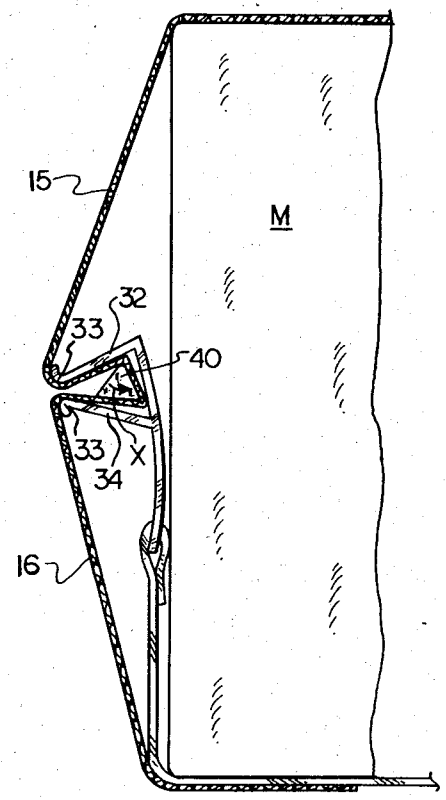
FIG. 5 is a side elevation showing the relationship of the wedge member to the clasp member and the rotation thereof when tension is applied to the bedclothing.

The perspective view in FIG. 1 illustrates the present bedclothing retainer 10 in position on a conventional mattress M and boxsprings BS. In this preferred embodiment each of the retaining devices 10 is attached to one exposed end of a harness 20 which is comprised of a plurality of elongated flat straps 22, joined at the intersections, and positioned between the mattress and boxsprings. Alternatively, the straps could be separate and applied individually for greater flexibility of placement. Preferably the straps 22 are made of an elastic material of a length approximately equal to the width or length of the given mattress. A plurality of straps 22 and retainers 10 are placed on the bed as illustrated in FIG. 1. The retainers 10 are attached by sewing or other conventional means to each end of the straps 22 and when positioned on the bed the retainers are positioned at spaced intervals along the outer edge of the mattress. Where the straps 22 are constructed from a non-elastic material, the length of the strap should be equivalent to either the width or length of a mattress of given size. Where the straps 22 are constructed from an elastic material, the length of the strap need be approximately the width or length of a given mattress. With an elastic strap 22, minor deviations in length or width of mattress are adjusted for by the elasticity of the strap. Further, the elasticity of the straps 22 cause the sheets to be kept taut upon a release of the tension. The spacing and arrangement of the straps 22 and retainers 10 is according to choice. In the embodiment shown in FIG. 1, there are three retainers along the sides of the mattress and two retainers on each end. The arrangement may of course may be modified according to the type of bedclothing.

The retainer or bedding clamp means 10 is shown in detail in FIG. 2. The clamping means is basically comprised of a clasp member 30 having a pair of opposing upper and lower gripping jaws 32 and 34 between which the bedclothing or sheet is gripped. A separate wedge member 40 is inserted between the gripping jaws to insert the bedclothing therein. The wedge member thereby feeds and locks the bedclothing in the clasp. Upper and lower jaws 32, 34 are integral to a continuous rear wall 36 that, during use, lies next to the side or end wall of the mattress with which it is associated. The wall 36 also serves to connect the clasp 30 to the straps 22. The harness strap 22 is attached to the clasp and rear wall 36 by means of a slot 38 cut into a lower edge thereof. The strap 22 is threaded through slot 38 and either sewn or glued together to form a retaining loop. It should be noted that there is a slight curvature to the wall 36 which allows the retainer to seat or position smoothly against the mattress.

Preferably the retaining mechanism 10 is made from a substantially rigid but slightly flexible polymeric material. The rigidity of the retainer of course makes it self-supporting; but the slight flexibility allows the retainer to flex sufficiently to seat itself properly against the mattress. Additionally, the jaws 32, 34 are structured so that they are angled toward each other. The inner surfaces of jaws 32, 34 and the upper portion 36' of the supporting wall form a substantially triangularly shaped channel 42 which receives the wedge lock member 40 therein.

The wedge member 40 is as illustrated a substantially triangular shaped piece of rigid material, preferably polymeric, that is inserted into channel 42 to trap the bedclothing therein. After the bedclothing or sheet is placed adjacent one end of channel 42, the wedge member 40 is inserted into the channel to feed and trap the sheet between the wedge member and the inner surfaces of jaws 32, 34 and rear wall 36'. The flexibility of the jaws 32, 34 allows them to be separated sufficiently to insert the sheet and the wedge member, but the memory of the polymeric material causes the jaws to return to their natural position shown in FIG. 2, closely retaining the wedge member therein. The positive gripping action of the jaw members 32, 34 is enhanced by the rotational movement of wedge member 40 when tension is applied to the bedclothing. This movement is best illustrated in FIG. 5 where it can be seen that as tension is applied to the sheet material or bedclothing, the natural tendency of the bedclothing is to pull out of clasp 30. However, with the present invention, the bedclothing pulls against the wedge member 40, causing it to rotate slightly in the direction of the arrow x.

FIG. 5 illustrates the embodiment of a clasp shown in FIG. 1 as it is placed in relationship to the mattress and sheet or covering. As the sheet is pulled over the top of the mattress and dcwn over the side wall of the mattress the overhanging portion of the sheet is folded inwardly and inserted between the adjacent lips 33 of the clasp by inserting the wedge member 40 in the clasp. The trapped portions of the sheet then form a loop around the wedge. The trailing edge portion 16 of the sheet overhang is then tucked tightly under the mattress in a conventional manner. Thus emplaced the sheet retainer is substantially concealed behind the sheet.

So attached, when tension created by normal movement on the bed occurs, the wedge member 40 rotates and the angular edges thereof tightly grip the looped portion of the sheet between the angular edges of the wedge and the inner surfaces of the walls of the jaws 32, 34 and the rear wall 36'.

Such rotation of the wedge member creates a positive gripping force against the sheet, which positive force prevents the wedge member from becoming dislodged and the sheet pulling out of the clasp. This type of secure entrapment of the sheet or bedclothing in the clasp is impossible to obtain with any of the prior art devices.

Figure 4:
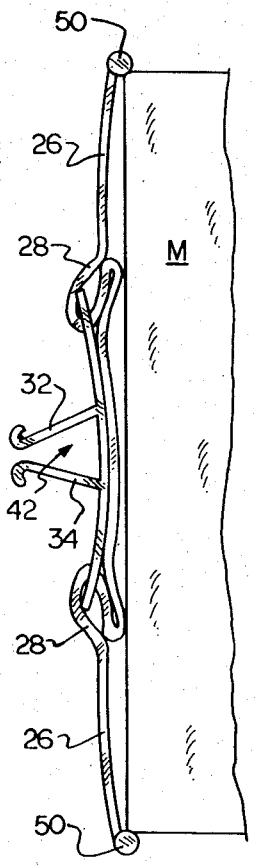
FIG. 4 is a side elevation of the mattress attachment means shown in FIG. 3.
Figure 3:
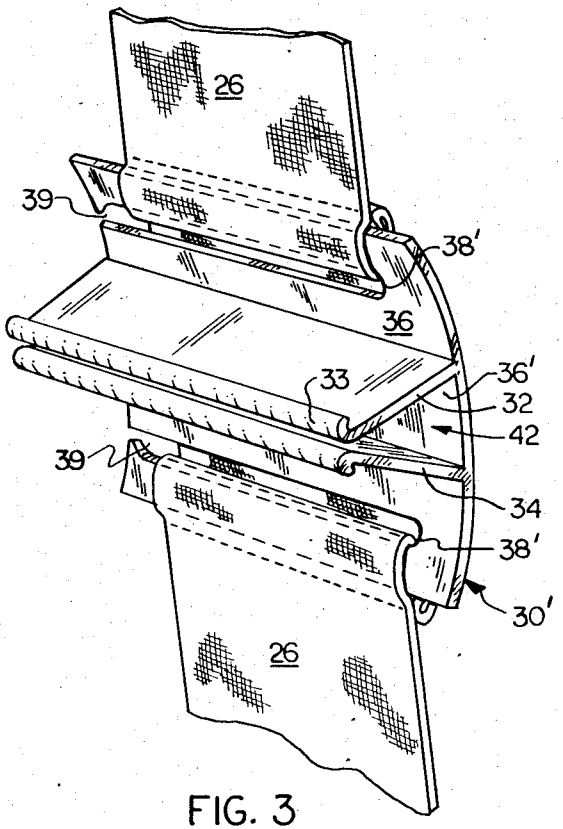
FIG. 3 is an enlarged perspective view of an alternate embodiment of the retaining device.

An alternate embodiment of the harness mechanism is shown in FIGS. 3 and 4. In this embodiment, rather than having elongated straps 22, the harness 20 is formed by the addition of elastic straps 26 which are sewn into edges of the mattress. Most mattresses include a cording 50 stitched into the circumference of upper and lower edges. The straps 26 are secured as desired at spaced intervals around the upper and lower edges of the mattress and stitched into place with the cording. The intermediate portion of straps 26 are looped and, if desired, stitched together to create pockets 28 which receive the retainers 10. FIG. 3 illustrates this embodiment of the retainer 10 where upper and lower jaws 32, 34 are positioned approximately mid-way between the upper and lower edges of rear wall 36. A pair of slots 38', having one open end 39, are provided in the retainer wall 36 as shown. The open ends of the slots permit insertion of the clasp member 30' through the elastic loop 28 for suspension of the retainer between the two straps 26.

Other and further additions and modifications may be made to the retainer described herein, with such modifications expected to remain within the scope of the claims below.

What is claimed is:

1. A device for holding bedclothes in position on a mattress; said device including:

(a) a plurality of clamping means positioned at spaced intervals around of the side and end walls of the mattress for releasably receiving and retaining a portion of the bedclothing therein; said clamping means including an assembly comprised of:

(i) a clasp member having a pair of opposing upper and lower gripping jaws which lie closely adjacent to each other to form a channel which receives the portion of the bedclothes therein;

(ii) an elongated wedge shaped member for inserting between said gripping jaws and locking the bedclothes between said clasp and said wedge;

(b) each of said clamping means further including a mechanism for applying a positive gripping action of said clamping means against the bedclothing as tension is applied to the bedclothing;

(c) means for positioning and maintaining said clamping means at selected spaced intervals around the mattress.

2. A device according to claim 1 wherein said means for positioning and maintaining said clamping means on the mattress includes a harness member comprising a plurality of elongated, flat straps having one of said clamping means attached to each end thereof; said straps being positioned between the undersurface of the mattress and the top of the mattress supporting surface, and said straps being of a length to extend beyond the width or length of the mattress such that said clamping means are positioned at opposing outer edges of the mattress.

3. A device according to claim 1 wherein said straps are joined at the intersections thereof to form said harness member.

4. A device according to claim 1 wherein said clamping means is attached to the side wall of the mattress.

5. A device according to claim 1 wherein said mechanism for increasing the gripping action of said clamping means comprises:

(a) said wedge member being of a size and cross-sectional shape, corresponding to said channel, but slightly smaller, whereby some clearance is provided for movement of said wedge when inserted over the bedclothing between said gripping jaws;

(b) said prescribed cross-sectional shape of said wedge member being substantially an angular shape;

(c) said wedge member being caused to rotate within said gripping jaws responsive to application of tension to the bedclothes;

(d) said rotation of said wedge member causing said angular shape to wedge against the inner surfaces of said gripping jaws and more tightly grip the bedclothes therebetween.

6. A device according to claim 5 wherein said angular cross-sectional shape of said wedge member is triangular.

* * * * *